United States Patent [19]

Wood et al.

[11] Patent Number: 4,947,080

[45] Date of Patent: Aug. 7, 1990

[54] APPARATUS FOR ROTATING AN ELECTRODELESS LIGHT SOURCE

[75] Inventors: Charles H. Wood; Wayne Johnson, both of Rockville, Md.

[73] Assignee: Fusion System Corporation, Rockville, Md.

[21] Appl. No.: 391,011

[22] Filed: Aug. 9, 1989

Related U.S. Application Data

[63] Continuation-in-part of Ser. No. 201,660, May 23, 1988, abandoned.

[51] Int. Cl.[5] ..... H01J 61/30; H01J 65/04

[52] U.S. Cl. ..... 315/248; 313/148; 315/112

[58] Field of Search ..... 403/155, 355, 378, 379; 315/248, 112; 313/49, 149, 148; 310/75 R, 75 D

[56] References Cited

U.S. PATENT DOCUMENTS 3,342,273 3/1966 Crane ..... 403/355

4,485,332 11/1984 Ury et al. ..... 315/112

*Primary Examiner*—Eugene R. LaRoche

*Attorney, Agent, or Firm*—Pollock, Vande Sande & Priddy

[57] ABSTRACT

A microwave generated light source including a lamp envelope having apparatus for rotating the envelope about an axis which includes an electric motor with a hollow shaft, an elongated stem attached to the envelope and extending within the hollow shaft and a wire-like spring clip for retaining the stem within the hollow shaft.

21 Claims, 3 Drawing Sheets

FIG. 1
PRIOR ART
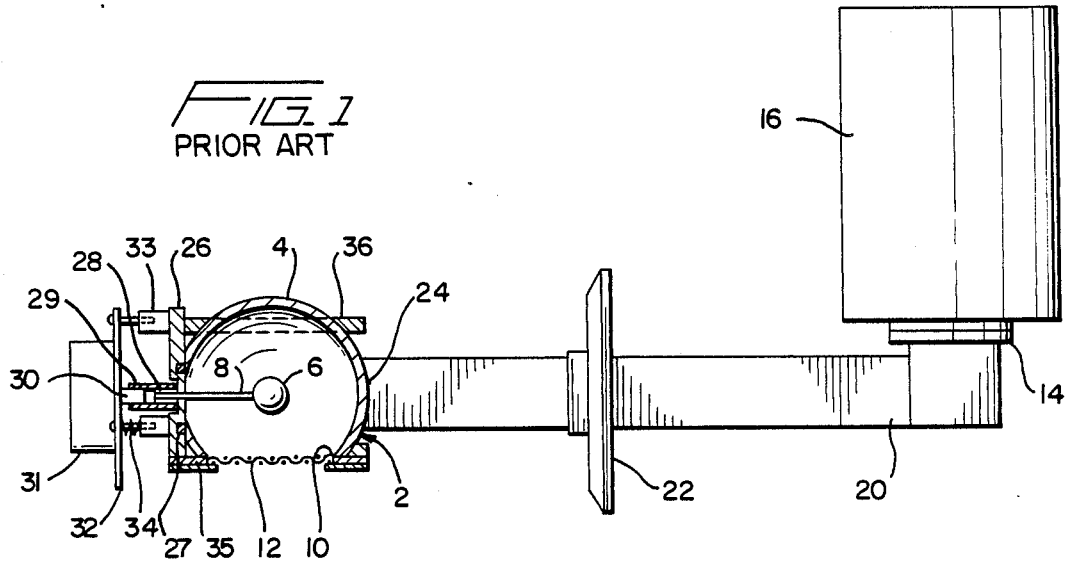
FIG. 2
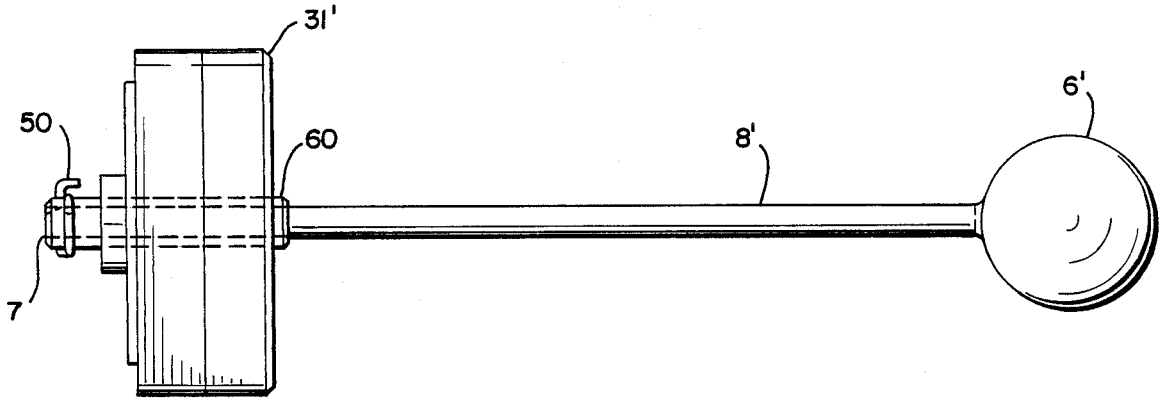
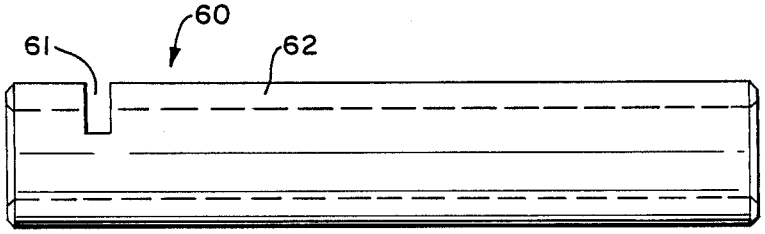
FIG. 3

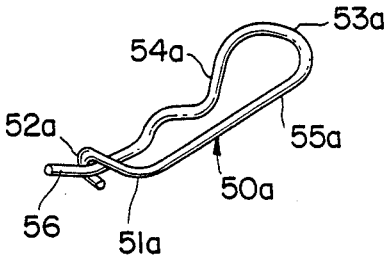
FIG. 7
FIG. 8
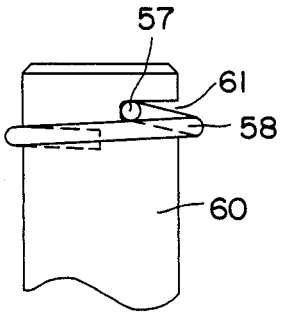
FIG. 10
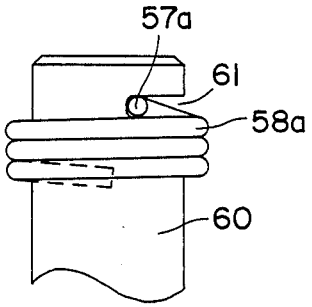
FIG. 9
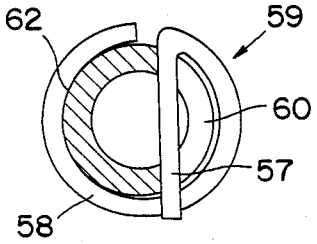
FIG. 11
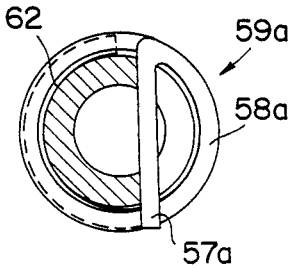

APPARATUS FOR ROTATING AN ELECTRODELESS LIGHT SOURCE

This application is a continuation-in-part of co-pending application Ser. No. 201,660, filed May 23, 1988, for "Apparatus for Rotating an Electrodeless Light Source", now abandoned.

The present invention relates to electrodeless lamps and more specifically to apparatus for rotating a lamp envelope in an electrodeless lamp.

BACKGROUND OF THE INVENTION

The electrodeless lamps with which the present invention is concerned generally comprise a lamp envelope containing a plasma-forming medium. To operate the lamps, the medium in the envelope is excited with microwave, R.F. or other electromagnetic energy, thereby generating a plasma, which emits radiation in the ultraviolet, visible or infrared part of the spectrum.

It is known that electrodeless lamps transfer a great deal of heat to the envelopes during operation, and it has been found that the effectiveness with which the lamp envelopes may be cooled is a limiting factor in overall lamp performance. Thus, the brightness with which energy is radiated by the lamp increases with the power density of the microwave or other energy in the lamp envelope, but as the power density increases, so does envelope temperature, with a point being reached where the envelope melts if it is not adequately cooled. Thus, the brightness which can be obtained from the lamp is ultimately a function of cooling. Also, in the case where a lamp is operating satisfactorily at a given envelope temperature, cooling the envelope further has the effect of substantially increasing bulb lifetime.

An improved method and apparatus for cooling electrodeless lamps is described in U.S. Pat. No. 4,485,332 issued Nov. 27, 1984 to Ury, et al. for "Method and Apparatus for Cooling Lamps". As disclosed therein, apparatus is provided for rotating the lamp envelope while a stream of cooling gas is passed over its outer surface. The lamp envelope is rotated by an electric motor which has its shaft secured to an elongated stem which is attached to the lamp envelope. The outer end of the elongated stem is provided with a metal ferrule which is cemented into a coupling. The coupling in turn is secured to the motor shaft as by a set screw or a ball detent arrangement.

Some improvements for electrodeless lamps require a reduction in the overall length of the distance between the motor and the lamp envelope. However, the length of the ferrulecoupling shaft combination cannot be reduced to a substantial extent.

SUMMARY OF THE INVENTION

It is accordingly an object of this invention to provide an electrodeless lamp component comprising a lamp envelope and a stem which are adapted for compact connection with a motor shaft.

It is another object of this invention to provide an improved interconnection between a lamp envelope and a driving motor for rotating the lamp envelope.

It is still another object of this invention to provide an interconnection between a lamp envelope and a driving motor which permits a compact assembly of these components.

In accordance with this invention, there is provided an electrodeless lamp component for a microwave generated light source wherein said component comprises a lamp envelope and an elongated stem integral with said envelope for rotatively coupling said envelope to a motor shaft for rotating said envelope about an axis and wherein said stem is adapted to fit within a hollow motor shaft and is provided with means for fixedly securing the stem to the hollow motor shaft.

Further in accordance with this invention, there is provided a microwave energized lamp having a lamp envelope integral with a stem which is secured to the shaft of an electric motor, wherein the shaft is hollow and the stem is adapted for insertion within the hollow shaft to provide a snug fit. Means are provided for securing the stem within the hollow shaft.

The resulting electrodeless lamp has a significantly reduced overall length which permits a more compact design. Furthermore, there is a reduction in the number of coupling parts, a greater length of engagement between the stem and the motor shaft, and a positive engagement between the stem and the shaft. Envelope replacement is easy and there is little wear between the coupling parts even after long term use.

BRIEF DESCRIPTION OF THE DRAWINGS

FIG. 1 is a view in partial section of an electrodeless lamp showing the coupling of a stem to the shaft of a motor in accordance with the prior art.

FIG. 2 is a view in section of an embodiment of the present invention.

FIG. 3 is a view in section of a hollow motor shaft.

FIG. 7 is an isometric view of another embodiment of a spring clip for securing the stem within the hollow shaft.

FIG. 8 is a side view of another embodiment of a spring clip which is shown mounted on a hollow shaft.

FIG. 9 is an end view of the embodiment of FIG. 8.

FIG. 10 is a side view of a modification of the embodiment of FIG. 8.

FIG. 11 is an end view of the embodiment shown in FIG. 10.

DETAILED DESCRIPTION OF THE INVENTION

Figure 4:
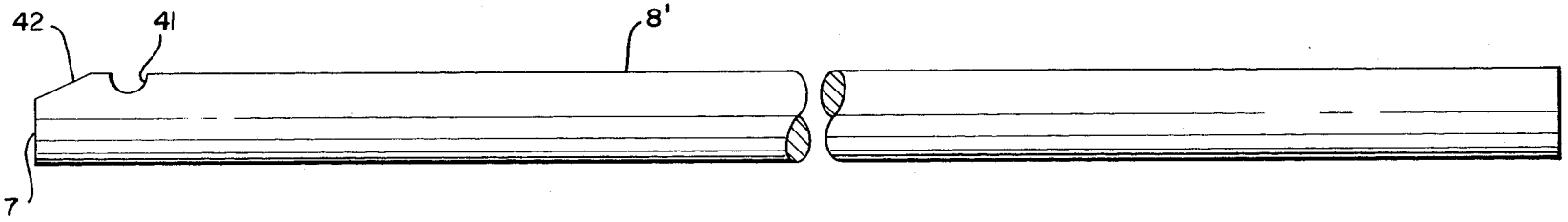
FIG. 4 is a side view of a stem adapted to engage the hollow shaft of FIG. 3.

FIG. 1 illustrates a microwave generated electrode light source showing a prior art means for coupling motor 31 to stem 8. Light source 2 is comprised of spherical lamp, envelope 6 and spherical microwave chamber 4 in which the envelope is disposed. The lamp envelope and stem are typically made of quartz while the chamber is made of a conductive material such as copper or aluminum. The envelope is held at the center of the chamber by mounting stem 8. Chamber 4 has a circular aperture 10 for emitting light. Aperture 10 is covered with conductive mesh 12 which is effective to retain microwave energy in the chamber while allowing the ultraviolet light emitted by lamp envelope 6 to escape.

Lamp envelope 6 is filled with a plasma-forming medium, such as, for example, mercury in a noble gas. When excited with microwave energy, this medium becomes a hot plasma which emits ultraviolet radiation.

The microwave energy is supplied by magnetron 14 which is powered by electrical power supply 16. The microwave energy emitted by the magnetron is coupled to chamber 4 by rectangular waveguide section 20, and coupling is optimized by tuning stub 22. Chamber 4 has a rectangular slot 24 therein for admitting the microwave energy to the chamber and exciting the plasma in envelope 6.

Motor 31 is provided for rotating the stem 8 of the lamp envelope. Flange 26 having gasket 27 thereon is disposed at the chamber opening, and is supported by screen mounting plate 35 at one end and support rods 36, which are alongside the chamber, at the other end.

Stem 8 is provided with a ferrule 28 at one end thereof which is secured in cylindrical coupling 29, as by cementing, while the motor shaft 30 is secured to the other end of the coupling 29 as with a set screw or ball detent (not shown). Thus, the stem 8 is effectively an extension of the motor shaft 30. The motor is attached to flange 32 which in turn is secured to flange 26 by mounting posts 33.

FIG. 2 is a schematic illustration of an embodiment of the present invention, and parts which are similar to those in FIG. 1 are identified with corresponding numerals. Referring to FIG. 2, lamp 6' is provided with elongated stem 8' which is mounted within hollow shaft 60 of motor 31'. As shown in FIG. 2, stem 8, is secured near its distal end 7 by spring clip 50 which extends through opening 61 of hollow shaft 60 and into opening 41 in the surface of stem 8', as shown in FIGS. 3 and 4. In the embodiment shown, opening 61 is a slit running perpendicular to the long direction of the shaft, while opening 41 is a groove in the stem running in the same general direction as the slit.

As used herein, the term "distal end" for the stem 8' and the hollow shaft 60 refers to the end farthest from spherical lamp envelope 6'.

FIG. 3 is a sectional view of hollow shaft 60 showing the position of slit 61 in the wall 62 near the distal end of the shaft.

Figure 5:
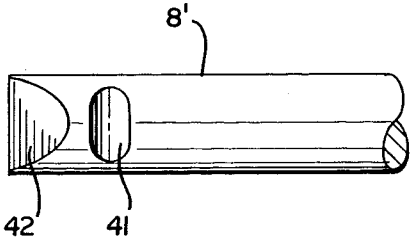
FIG. 5 is a top view of the end of the stem shown in FIG. 4.

FIGS. 4 and 5 are sectional views of the stem 8' showing groove 41 for engaging a spring clip and slanted surface 42. This slanted or chamfered surface provides easy assembly of stem 8' within hollow shaft 60 and engagement of spring clip 50 with slit 61.

Figure 6:
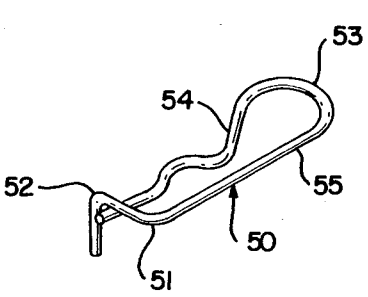
FIG. 6 is an isometric view of one embodiment of a spring clip for securing the stem within the hollow shaft.

FIG. 6 is an isometric view of U-shaped spring clip 50, having curved portion 53 interconnecting legs 54, 55. As shown, leg 55, which functions to hold groove 41 in registry with slit 61, is provided with two 90° bends 51, 52 in the end position to restrict the extent of the separation of legs 54, 55 and thus prevent accidental removal of the spring clip when it is mounted in slit 61 of shaft 60.

FIG. 7 is an isometric view of a preferred embodiment of the spring clip shown in FIG. 6. In this embodiment, the outer end 56 of leg **54*a* is angled upwardly, i.e., away from leg 55*a*, and a U-shaped portion 52*a* is provided on the end of leg 55*a* for hooking over portion 56**.

FIGS. 8 and 9 are side and end views, respectively, of an embodiment of a spring clip-hollow shaft combination in which the spring clip 59 has a circular portion 58 for bearing against the outer surface 62 of the hollow shaft 60 and straight chord portion 57 for engaging groove 61.

FIGS. 10 and 11 are side and end views, respectively, of a preferred embodiment in which the circular portion of the spring clip is helical and includes a plurality of turns **58*a***, preferably the helical portion contains at least about 2 turns (720°) and most preferably from about 2 to about 3 turns.

It should be appreciated that the present invention solves the problem of shortening the bulb stem by providing a motor with a hollow shaft and a stem which is adapted for being secured with the shaft. Expedients for effecting such securing, other than illustrated herein, may occur to those skilled in the art, and are considered to be within the scope of the invention.

Having thus described the invention, the following Example is offered to illustrate it in more detail.

EXAMPLE

A 5 Watt synchronous motor designed for a speed of 300 RPM at 60 Hz. is provided with a hollow shaft having an internal diameter of 0.1590 inches, an external diameter of 0.250 inches and a length of 1.37 inches. A slit 0.045 inch wide and 0.090 inch deep is provided about 0.12 inch from the distal end of the shaft.

A stem for a spherical lamp envelope about 6 inches long and having a diameter of 4 mm is provided with a chordal groove 0.030 inch deep, 0.15 inches from the distal end of the stem. A ramp at an angle of 25° from the horizontal is provided at the distal end of the stem as shown in FIGS. 4 and 5.

The stem fits snugly in the hollow shaft and is secured in place with a spring clip which extends through the slit in the hollow shaft and into the groove in the stem whereby relative axial or rotational mount of the stem and the shaft are prevented. Although the stem is positively secured within the hollow shaft, it is easily removed by holding the shaft, rotating the bulb stem in either direction and then pulling the bulb.

It should be appreciated that while the invention has been described in connection with a preferred embodiment illustrating a particular electrodeless lamp, it may be used with other electrodeless lamps which may be rotated, and it should be understood that many variations which fall within the scope of the invention may occur to those skilled in the art, and that the scope of the invention is limited solely by the claims appended hereto and equivalents thereof.

What is claimed is:

1. An electrodeless lamp component for a microwave-generated light source, said lamp component comprising a lamp envelope and an elongated stem integral with said envelope, wherein said stem is adapted to fit within a hollow motor shaft and is provided with means for permitting said stem to be removably secured within said hollow motor shaft.

2. A lamp component according to claim 1 wherein said means for permitting said stem to be removably secured within said hollow shaft comprises a radially-extending chordal groove adapted for registration with a radially-extending slot of said hollow shaft.

3. A lamp component according to claim 2 wherein said groove is in a distal portion of said stem.

4. A lamp component according to claim 1 wherein said stem is provided with a distal end surface having a reduced cross-sectional area thereby facilitating assembly of said lamp component and said hollow motor shaft.

5. A lamp component according to claim 4 wherein said stem is provided with a ramp-like portion extending from said end surface to the cylindrical surface of said stem.

6. An electrodeless lamp component for a microwave powered light source, said lamp component comprising a lamp envelope and a stem integral with said envelope, said stem being adapted to fit within a hollow motor shaft, and having an opening in its surface for permitting the stem to be secured within said hollow motor shaft.

7. An electrodeless lamp component in accordance with claim 6 wherein the end of said stem has a chamfered portion.

8. An electrodeless lamp component for a microwave powered light source, said lamp component comprising a lamp envelope and a stem integral with said envelope, said stem being adapted to fit within a hollow motor shaft, and having a groove in its surface for permitting the stem to be secured within said hollow motor shaft.

9. A microwave-generated light source comprising a lamp envelope mounted within a microwave cavity and means for rotating said envelope about an axis, wherein said means for rotating said envelope comprises:

(a) an electric motor operatively associated with said envelope, said motor having a hollow shaft;
(b) an elongated stem attached to said envelope and extending within said hollow shaft; and
(c) means for securing said stem within said hollow shaft.

10. A light source in accordance with claim 9 wherein said hollow shaft is provided with a slit in the wall thereof, said slit being in a plane which is perpendicular to the rotational axis of said shaft, said stem is provided with a groove for registration with said slit, and said means for securing said stem with said shaft comprises a wire-like spring clip for securing said slit in registration with said groove.

11. A light source in accordance with claim 10 wherein said spring clip comprises a substantially U-shaped wire having first and second legs and wherein one of said legs of said U-shaped wire is bent at one end thereof to restrict the separation of said legs.

12. A light source according to claim 11 wherein the bend at said one end of one of said legs is substantially U-shaped.

13. A light source according to claim 10 wherein said spring clip has a circular portion for bearing on the outer surface of said hollow shaft and a straight portion for retaining said slit and said groove in registration.

14. A light source according to claim 13 wherein said circular portion is helical.

15. A light source according to claim 14 wherein said helical portion turns through an angle of at least about 720°.

16. A light source in accordance with claim 10 wherein said stem extends through said shaft substantially the length thereof, and said groove in said stem and said slit in said shaft are near the distal ends thereof.

17. A light source in accordance with claim 10 wherein the distal end surface of said stem is provided with a reduced cross-sectional area.

18. A light source in accordance with claim 10 wherein the distal end portion of said stem has a ramp-like portion extending from the end surface thereof to the cylindrical surface of said stem.

19. A microwave-generated light source comprising a lamp envelope mounted within a microwave cavity and means for rotating said envelope about an axis, wherein said means for rotating said envelope comprises:

(a) an electric motor operatively associated with said envelope, said motor having a hollow shaft;
(b) an elongated stem extending from said envelope and including means for enabling attachment of the stem to the hollow shaft; and,
(c) means for attaching said stem within said hollow shaft, wherein said means for attaching cooperates with said means on said stem for enabling its attachment.

20. A microwave-generated light source comprising a lamp envelope mounted within a microwave cavity and means for rotating said envelope about an axis, wherein said means for rotating said envelope comprises:

(a) a motor operatively associated with said envelope, said motor having a hollow shaft which is defined by a shaft wall, said shaft wall having a first opening;
(b) an elongated stem attached to said envelope and extending within said hollow shaft, said stem having a second opening; and,
(c) means which cooperates with said first and second openings for holding said stem within said hollow motor shaft.

21. A light source in accordance with claim 20 wherein said means for holding said stem comprises a spring clip.

* * * * *